US005404341A

United States Patent [19]

Horiguchi

[11] Patent Number: 5,404,341

[45] Date of Patent: Apr. 4, 1995

[54] TIME MEASUREMENT APPARATUS

[75] Inventor: Katsuhiro Horiguchi, Tokyo, Japan

[73] Assignee: Seiko Instruments Inc., Japan

[21] Appl. No.: 140,216

[22] Filed: Oct. 20, 1993

[30] Foreign Application Priority Data

Nov. 20, 1992 [JP] Japan ..... 4-311706

[51] Int. Cl.[6] ..... G04F 8/00; G04F 10/00

[52] U.S. Cl. ..... 368/110; 368/113

[58] Field of Search ..... 368/107-113, 368/250, 251

[56] References Cited

U.S. PATENT DOCUMENTS 4,236,375 12/1980 Komaki ..... 368/73
4,523,857 6/1985 Ushikoshi ..... 368/157
4,637,732 1/1987 Jones et al. ..... 368/109
4,991,156 2/1991 Suga ..... 368/113
5,050,141 9/1991 Thinesen ..... 368/73
5,130,955 7/1992 Luerker et al. ..... 368/3
5,130,957 7/1992 Nakabayashi ..... 368/110

*Primary Examiner*—Vit W. Miska
*Attorney, Agent, or Firm*—Adams & Wilks

[57] ABSTRACT

A time measurement apparatus provides reliable estimation of a current LAP time by comparing it with a standard LAP time. A LAP time watching circuit compares the data in a LAP time measuring circuit with a data in a standard LAP time memory circuit, and outputs a LAP time coincidence signal to an output signal memory circuit. The output signal memory circuit drives an audible indicator.

17 Claims, 11 Drawing Sheets

TIME MEASUREMENT APPARATUS

BACKGROUND OF THE INVENTION

The present invention is related to a time measurement apparatus such as a stopwatch, a chronograph watch and etc. that is capable of measuring a LAP time.

There exists in the prior art a so-called "combination watch" with chronographic function that have two display elements—analog and digital. And here, there exists roughly classified notion of two "time"s, that is, of a LAP time and a split time in measurement by a stop watch. A LAP time means an elapse of time between the first LAP operation timing and the next LAP operation timing after starting measurement, which measured by plural number of LAP timing apparatus.

In contrast to above, a split time means total sum of specific LAP times above that passed through after standing. In the prior art, the "combination watch" with chronographic function is known an apparatus that has a function that can foresee a timing of a next LAP operation. This type of a watch in chronographic mode, displays, in the digital display portion, a chronographic split time (total addition of time from the start) or LAP time (a period of time), and in the analog display portion a simulational display with a hand of which a revolution is equal to 100% of the latest LAP time or the target LAP time. For example, in watching a circuit racing of an auto competition, a spectator wishes to avoid the delay of LAP operation because of the reason that the target passes through too fast in front of the spectator and then that the recognition of the target delays. This kind of the delay will be avoided by showing that the hand of the watch circulates in proportion to the percentage of the elapse of time out of 100% of the latest LAP time or the target LAP time in one turn that simulates a circuit running of the auto.

On the other hand, a stop watch is also known with a function that the LAP time difference is calculated and displayed between a standard LAP time and a LAP time measured. By this function, a watcher can identify how fast or how slow LAP time is, compared with a standard LAP time.

Even with these prior art "combination watches" with chronographic function, a problem exists in that a spectator can not concentrate on watching the race, because a user of this apparatus has to see and check very often the display of the apparatus in order to foresee the timing of the next LAP operation with the hand simulation described above. Moreover, because the hand circulates one turn for 100% of the latest LAP time or the target LAP time, there exists another problem that it is difficult to forecast the next timing of LAP operation just before, or very close to the final stage of the hand circulation in case that the LAP time is comparatively close and moreover, even a stop watch that shows a LAP time difference has a problem that the LAP time difference can not be identified without carefully watching the display.

SUMMARY OF THE INVENTION

It is an object of this invention to provide a time measurement apparatus capable of forecasting the next timing of LAP operation and comparing with a standard LAP time without watching the display.

In order to solve the problems above, discussed in a first embodiment a time measurement apparatus having a stopwatch and chronograph that is capable of LAP time measurement, comprises a standard LAP time memory means storing the current LAP time, or such a standard LAP time and is to be preset with a switch, LAP time watching means for watching whether or not a current LAP time coincides with a period of time obtained by substracting a determined time from a standard LAP time stored in the LAP time memory means, output signal memory means that generates a output signal for driving informing means in accordance with the output of the LAP time watching means, a driving circuit, and informing means.

In a second embodiment, the time measurement apparatus having a stopwatch and a chronograph that is capable of measurement of LAP time, comprises standard LAP time memory means, LAP time difference calculating means that calculations time difference between a LAP time and a standard LAP time through operation by a switch and outputs its LAP time difference signal, output signal memory means that generates an output signal that drives informing means in accordance with the LAP time difference signal, a driving circuit, and informing means.

In an apparatus of the first embodiment above, the latest LAP time to be measured by a LAP operation, standard LAP time or target LAP time, etc., as is set by a switch are stored in standard LAP time memory means, and when a new LAP time is initiated to be measured by SAP operation, it is continuously watched by LAP time watching means whether not the LAP time now in process of measurement coincides with the period of a time obtained by substracting a determined time from a LAP time stored in the standard LAP time memory means. Moreover, at the occasion when the LAP time now in process of measurement coincides with the period of a time obtained by substracting a determined time from a LAP time stored in the standard LAP time memory means, an output signal is generated by the LAP time watching means and output signal memory means and an output signal to the for driving informing means is generated. Since through this operation a signal is conveyed only when a current LAP time coincides with the time obtained by substracting a measurement comes just into the time substracting a determined time from a standard LAP time, a next LAP operation timing can be foreseen.

In an apparatus of the second embodiment above, a standard LAP time of the latest LAP time measured by LAP operation, the target LAP time set by switch, etc. is memorized in standard LAP time memory means, and in LAP time difference calculating means calculates the LAP time difference between the LAP time measured by LAP time calculating means and the standard LAP time is calculated and a LAP time difference signal is output to output signal memory means in accordance with the LAP time difference above. From output signal memory means, an output signal in accordance with the LAP time difference is output to the informing means. When the LAP operation is done, through this movements above, the information corresponding to the difference between the LAP time immediately after the measurement and standard LAP time is made, that is to say, the information in accordance with the LAP time difference above is made. Accordingly, the information of the LAP time difference can be recognized.

DETAILED DESCRIPTION OF THE PREFERRED EMBODIMENTS

The present invention will be described in the following in connection with the embodiments thereof with reference to the accompanying drawings.

Figure 1:
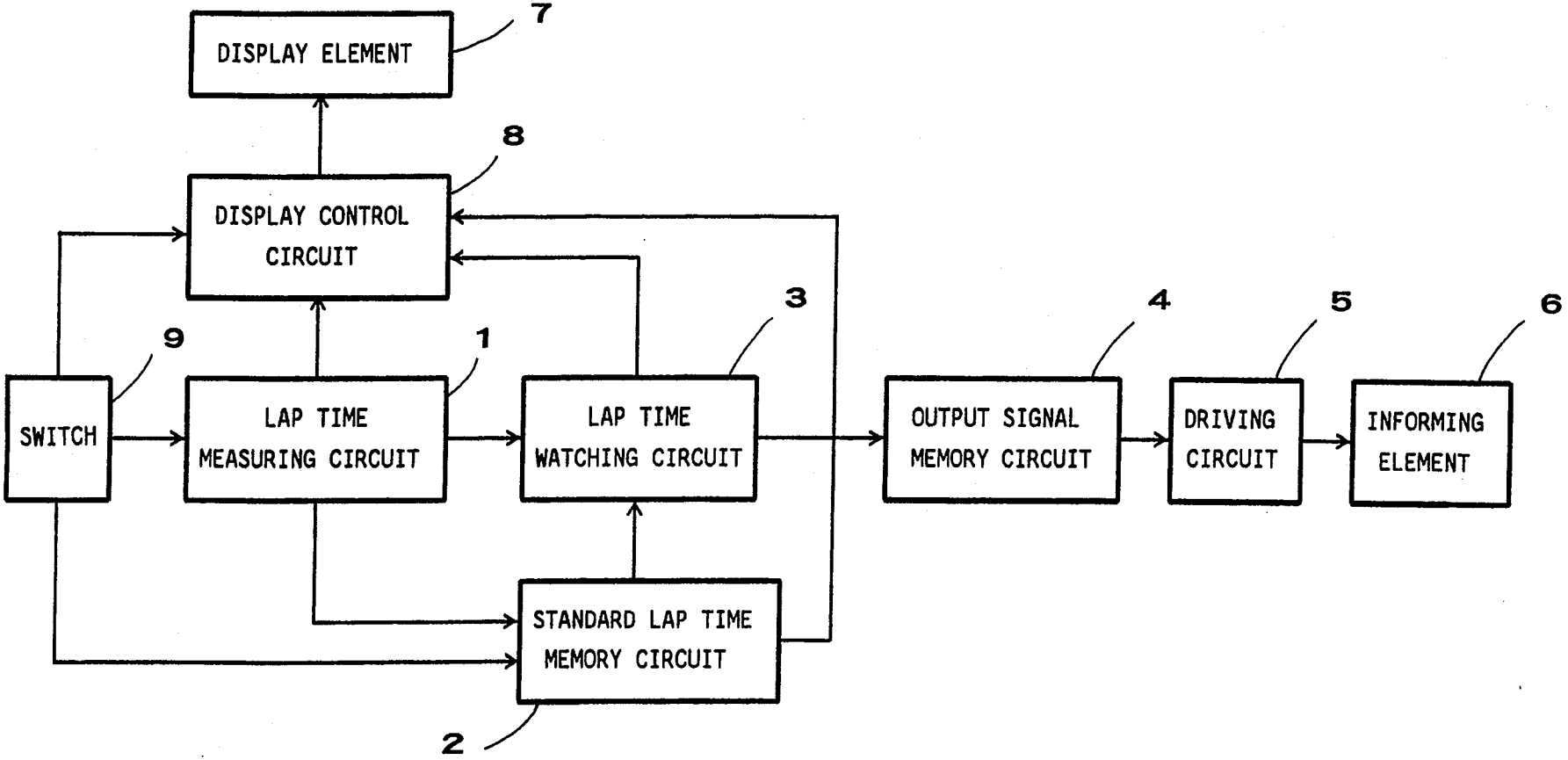
FIG. 1 shows a function block diagram of the first embodiment in a time measurement apparatus in the present invention.

FIG. 1 shows the Function block diagram in relation to the first embodiment of a time measurement apparatus in the present invention. In LAP time measuring circuit 1, LAP time measurement including the hour, minute, second, and 1/10 second of an event is performed. Standard LAP time memory circuit 2 stores a LAP time to be used as a standard such as the latest LAP time measured by LAP time measuring circuit 1, or a target LAP time set by a switch 9. LAP time watching circuit 3 watches if the LAP time now in the process of being measured by the LAP time measuring circuit 1 coincides with the timing which is equal to the value obtained by substracting a pre-determined time from a standard LAP time memorized in standard LAP time memory circuit 2, and when such coincidence is identified, a LAP time coincidence signal is output into output signal memory circuit 4. Output signal memory circuit 4 drives informing element 6 by way of a driving circuit 5, receiving the LAP time coincidence signal from LAP time watching circuit 3.

For example, assuming that a target LAP time is 1 minutes 50 seconds and that a pre-determined time is 10 seconds, a datum of 1 minute 50 seconds is memorized in standard LAP time memory circuit 2. Or, for the purpose of easy watching, in the standard LAP time memory circuit 2 is memorized a datum of 1 minute 40 seconds, which is a beforehand calculation of a value obtained by substracting a predetermined time 10 seconds from a target LAP time 1 minute 50 seconds. Once the LAP time measurement is initiated in the LAP time measuring circuit 1, LAP time measuring circuit 1 continuously watches if the LAP time now in process of being measured coincides with the above-mentioned 1 minute 40 seconds, and at the timing of any such coincidence above, outputs a LAP time coincidence signal to output signal memory circuit 4, and drives the informing element 6 by way of the driving circuit 5. That is to say, when the LAP time now in process of being measured equals and just passes through 1 minute 40 seconds which is equal to the target LAP time of 10 seconds before 1 minute 50 seconds, the information conveyance is made and accordingly it is recognized that the standard LAP time is coming closer.

Informing element 6 may make a sound like a speaker or may be with a motor which generates vibrations. Display element 7 displays such information as a LAP time, a standard LAP time, etc. For this purpose, the display element may be a digital display like an LED or LCD or may be analog display by means of a hand or otherwise. A display control circuit 8 controls the contents output to display element 7 and controls how to display. Through a switch 9 such operation are made, as of LAP time measuring circuit 1 in relation to its measurement (start, stop, LAP, reset etc.), of conversion and reconversion of displayed information, and of setting standard LAP time, and etc.

Figure 3:
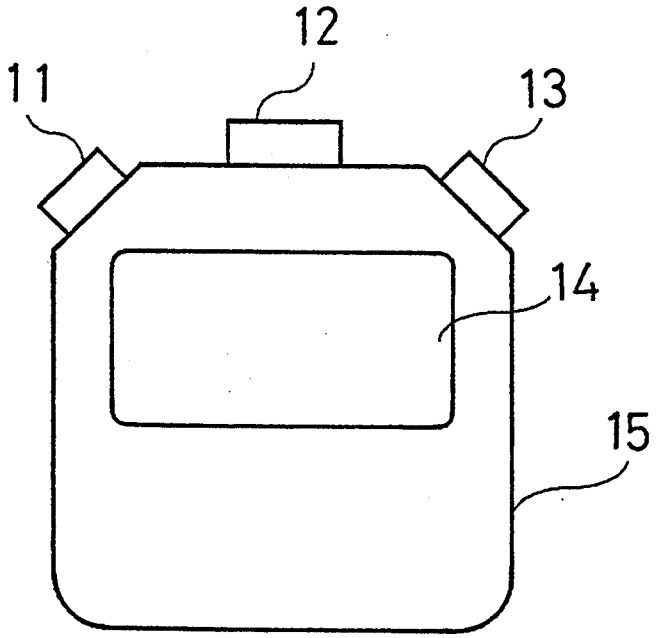
FIG. 3 shows an external appearance of the first and second embodiment in a time measurement apparatus in the present invention.

FIG. 3 shows an external appearance of the first embodiment and the second embodiment of a time measurement apparatus in accordance with the present invention. On the upper sides of the main case of the time measurement apparatus 15 exists 3 switches 11, 12, 13, the layout of which is neatly arranged for easy operation, and a display panel 14 is formed of LCD (liquid crystal display) which operates with lower energy consumption.

Figure 4:
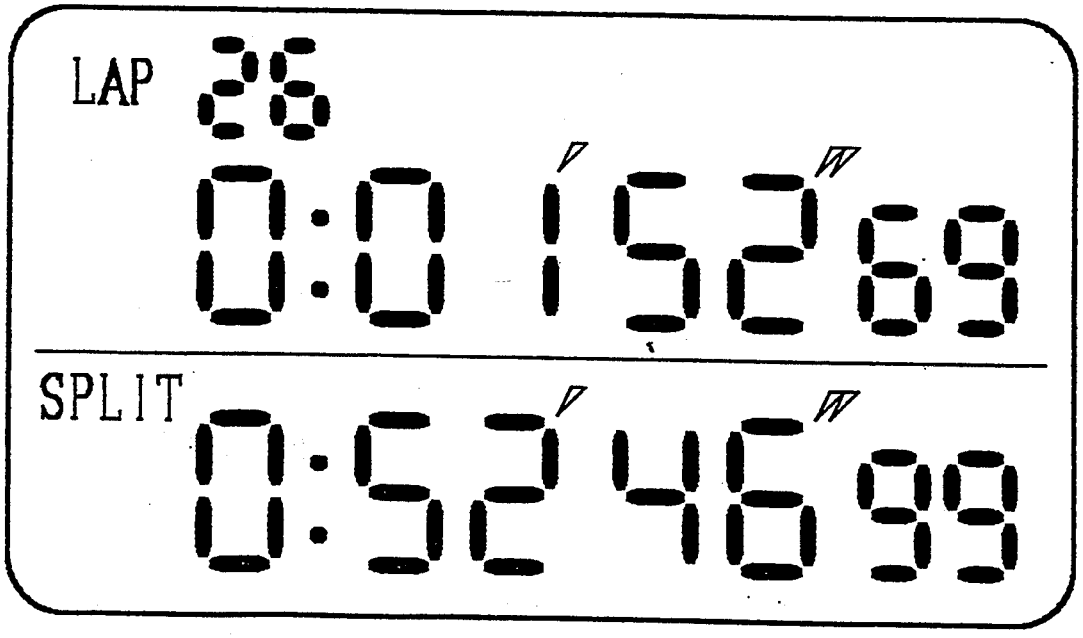
FIG. 4 shows an external appearance of a display means of the first and second embodiment in a time measurement apparatus in the present invention.

FIG. 4 shows an external appearance of the first embodiment and the second embodiment of a time measurement apparatus in accordance with the present invention. At the upper portion the LAP number is displayed, at the middle LAP time is displayed, and at the lower split time.

Figure 5:
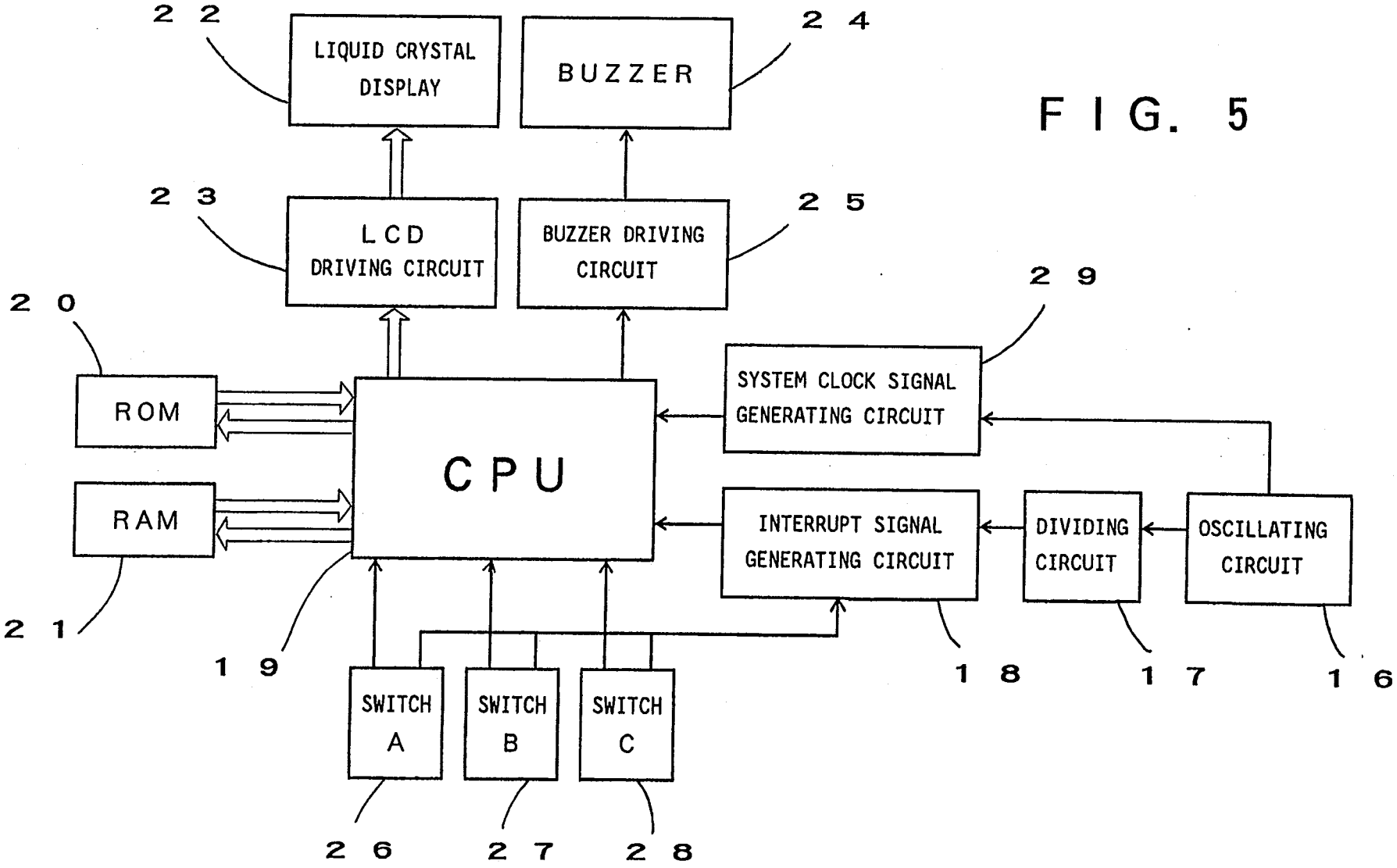
FIG. 5 shows a systems block diagram of the first and second embodiment in a time measurement apparatus in the present invention.

FIG. 5 shows a systems block diagram of the first embodiment and the second embodiment of a time measurement apparatus in accordance with the present invention. An output signal from an oscillating circuit 16 is input into a dividing circuit 17, which outputs plural numbers of timing signals into a interrupt signal generating circuit 18. Into this interrupt signal generating circuit 18, the timing signal above and output signals from switches 26, 27, 28 are input and the interrupt signal generating circuit 18 generates an interrupt signal into CPU (central processing unit) 19. CPU 19 receives systems clock signal from systems clock signal generating circuit 29 and drives a program stored in ROM (read only memory) 20 due to an interrupt signal from the interrupt signal generating circuit 18. According to the procedures of this program, LAP time measurement or LAP time watching etc. are processed. Moreover, CPU 19 drives a liquid crystal display driving circuit 23 and a buzzer driving circuit 25, and through these operation, a liquid crystal display 22 and a buzzer 24 are driven. In a RAM (random access memory) 21 are memorized such data as LAP time, standard LAP time, etc. and the renewal or storing into those, of many kinds of data or information are also processed through such a program operation as above.

Figure 6:
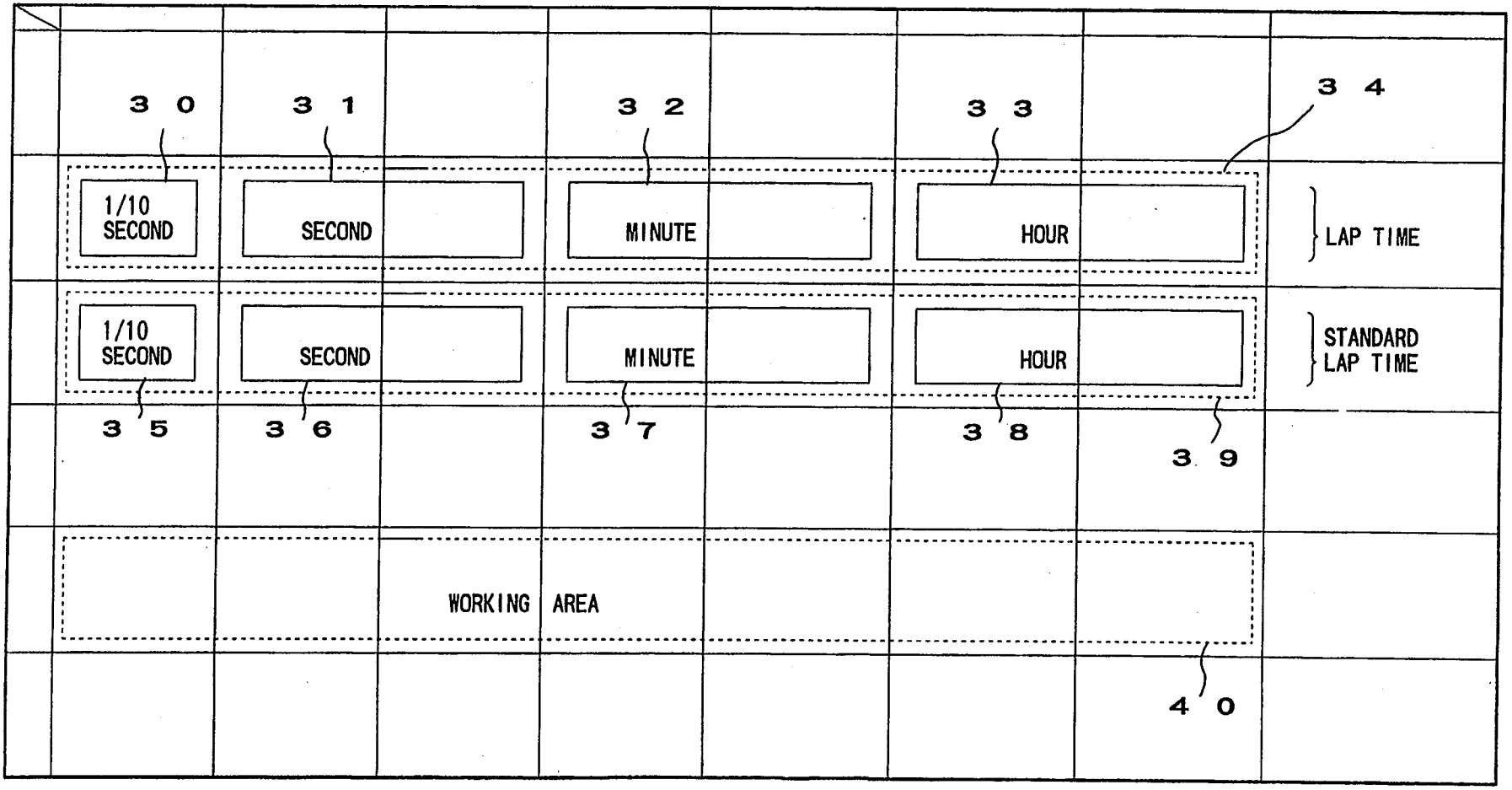
FIG. 6 shows a RAM MAP of the first embodiment in a time measurement apparatus in the present invention.

FIG. 6 shows a RAM MAP of the first embodiment of a time measurement apparatus in the present invention, which shows how many kinds of data are stored in RAM. LAP time data 34 consists of 1/10 second datum 30, second datum 31, minute datum 32, hour datum 33, those of which data are renewed respectively along with the elapse of LAP time in every 1/10 second, second, minute, and an hour. A standard LAP time data 39 also consists, the same as the LAP time data above, of 1/10 second datum 35, second datum 36, minute datum 37, and hour datum 38.

Figure 8:
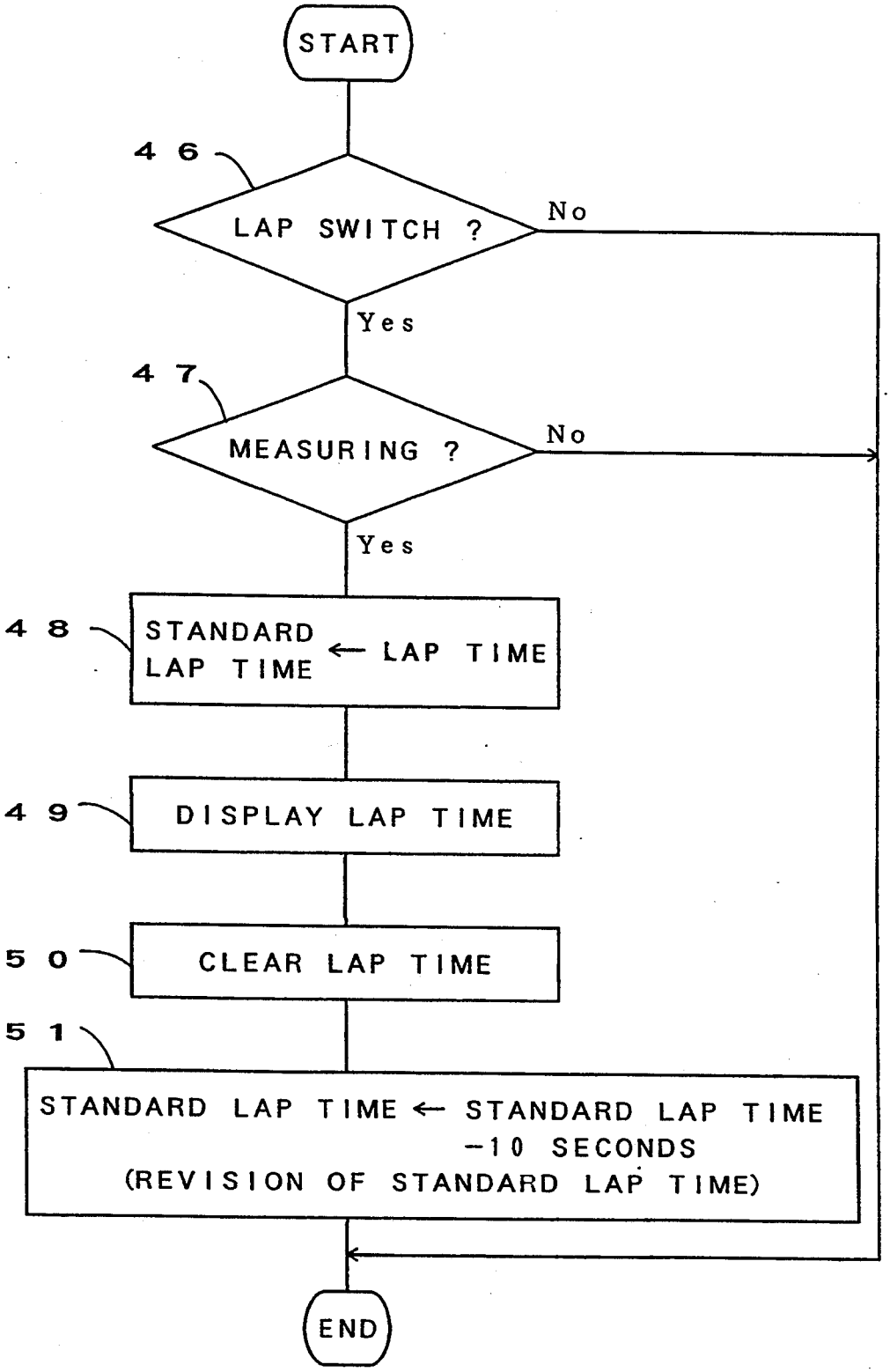
FIG. 8 shows a flow chart of LAP switch operation procedure of the first embodiment in a time measurement apparatus in the present invention.
Figure 9:
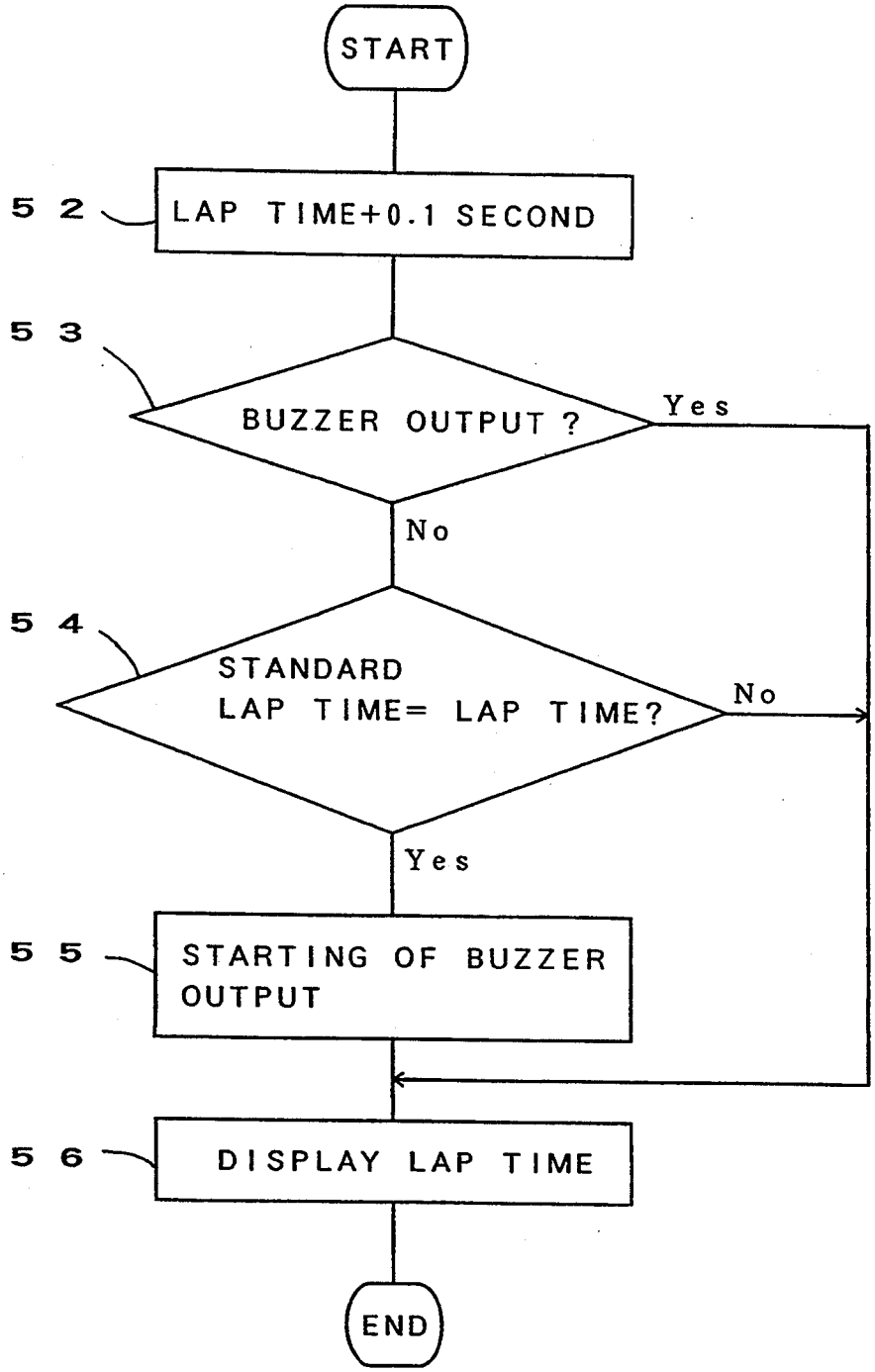
FIG. 9 shows a flow chart of LAP time watching operation procedure of the first embodiment in a time measurement apparatus in the present invention.

FIG. 8 shows a flow chart of a procedures of LAP switch operation in the first embodiment of a time measurement apparatus in accordance with the present invention. FIG. 9 shows a flow chart of a procedures of LAP time watching operation in the first embodiment of a time measurement apparatus in accordance with the present invention. The operations in the first embodiment will be explained in the following according to the flow chart.

In FIG. 5, assuming that one of switches 26–28 is assigned as a LAP switch, an interrupt by key into CPU 19 is done and LAP switch procedure is processed once the switch above is pushed. According to FIG. 8, LAP switch procedure will be hereinafter explained. LAP switch is the switch by which input is made (step 46), and in the case that LAP time is now in the process of being measured, the following procedure is processed. The LAP time datum 34 at the timing of input by the LAP switch is transferred into standard LAP time data area 39 (step 48), and at the same time the LAP time is displayed on LCD 22 (step 49). Once input is made by LAP switch, LAP time data area 34 is cleared for the purpose of restarting LAP time measurement (step 50), and moreover, the datum revision of standard LAP time data 39 is made. The datum revision is for easy watching of LAP time, that is, in reality the deduction of a predetermined time from a standard LAP time is made beforehand. Here in particular, the datum of substracting 10 seconds from standard LAP time is stored into as standard LAP time datum (step 51).

Next, a procedure of LAP time watching will be explained in the following according to FIG. 9. In LAP time measurement out of several interrupting procedures, counting is made according to interrupting procedure by 10 Hz timing. Everytime a 10 Hz interrupting signal occurs, in 0.1 second is added on LAP time, LAP time measurement is made (step 52). In the case that a buzzer for sound an output was already done when the LAP time now in process of measurement has elapsed over the standard LAP time, the following procedure of LAP time watching (step 53) is not done. In case that a buzzer sounding an output has not yet been done, a comparison of the LAP time now in process of measurement with the standard LAP time is made (step 54), and a buzzer sounding an output is initiated at the time of the coincidence of the comparison above (step 55) exists. At the last step, the LAP time now in process of measurement is displayed on LCD 22 (step 56).

Figure 11:
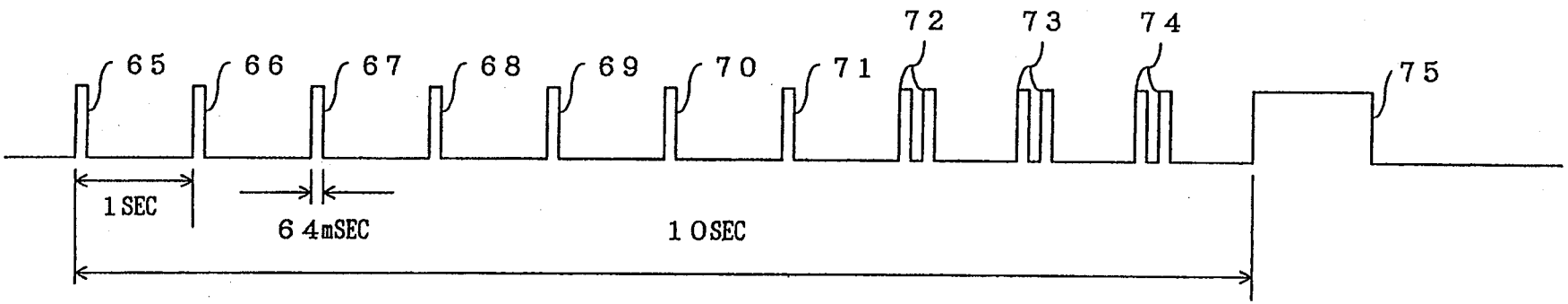
FIG. 11 shows a buzzer driving wave form of the first embodiment in a time measurement apparatus in the present invention.

FIG. 11 shows a buzzer driving wave form in the first embodiment of time measurement apparatus in accordance with the present invention. Through the LAP time watching procedure, once the LAP time currently being measured and standard LAP time coincides with each other, an output to buzzer is initiated. Then a buzzer driving wave as shown in FIG. 11 is output from a buzzer driving circuit 25 into a buzzer 24. But when the buzzer output level is "High" in FIG. 11, a rectangular wave of 4 kHz is assumed to be output. Until the 6th second from the buzzer output initiation, about 63 mili-second shot sound output signal is generated every 1 second (driving wave form 65–71). Moreover, from the 7th second to the 9th second, pairs of two shot sound output signals with an interval of 1 sec. between pairs are generated at every 1 second (driving wave form 72–74), and a continuous sound of 1 second is generated at 10th second (driving wave form 75).

As is explained above, shot sounds are generated for 10 seconds and a continuous sound of 1 second is at last generated, if the current LAP time coincides with standard LAP time (in this case, standard LAP time means the LAP time of which the revision is made in step 51). But since the standard LAP time with which LAP time in LAP time watching procedure is compared is the time of 10 seconds before LAP time (the previous LAP time) at the timing of input by LAP switch, the real behavior is as follows. Once the LAP time now in process of measurement comes to the 10 seconds before standard LAP time (the previous LAP time of the one at when LAP switch is activated) shot sounds are output for 10 seconds and a 1 second continuous sound occurs at the exact timing of coincidence of LAP time with standard LAP time.

Figure 2:
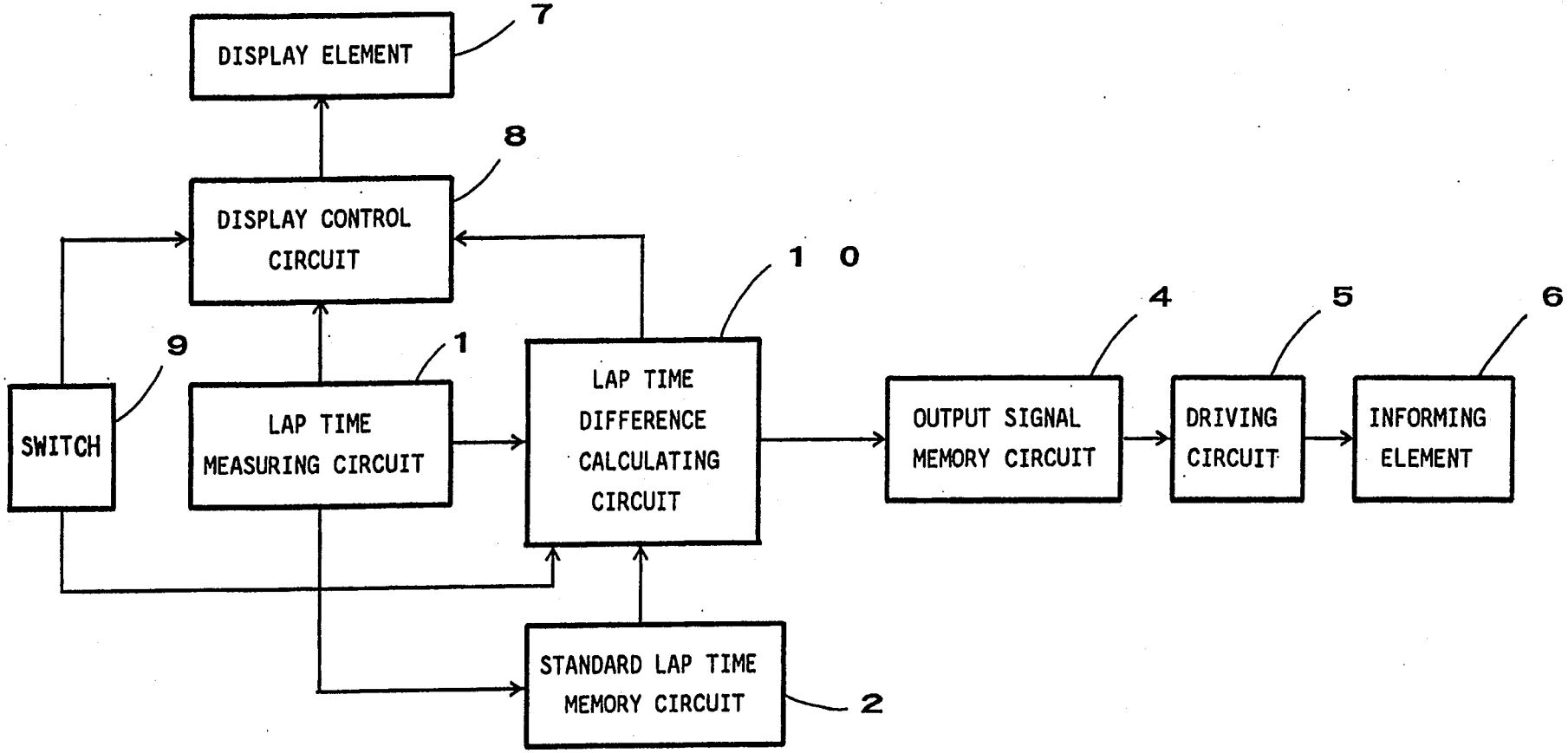
FIG. 2 shows a function block diagram of the second embodiment in a time measurement apparatus in the present invention.

Next, the operation of the second Embodiment will be explained in the following. FIG. 2 shows a function block diagram of the second embodiment of a time measurement apparatus in accordance with the present invention. Elements other than the LAP time difference calculating circuit 10 are the same as in the first embodiment. Once in LAP time measuring circuit 1, an input by a switch 9 is made while LAP time is now in process of measuring, a LAP time difference is calculated between the standard LAP time memorized in standard LAP time memory circuit 2 and the LAP time measured by LAP time measuring circuit 1, and LAP time difference signal is output to the output signal memory circuit 4, which then drives informing element 6 by way of a driving circuit 5 in accordance with a LAP time difference signal from LAP time difference calculating circuit 10.

For example, assuming that a target LAP time is equal to 1 minute 50 seconds, a datum of 1 minute 50 seconds is stored in standard LAP time memory circuit 2. If a LAP time is measured as 1 minute 47 seconds by LAP time measuring circuit 1 through the LAP operation by a switch 9 as input in the process of LAP measuring, a LAP time difference (it is 3 seconds in this particular case) between LAP time and standard LAP time is calculated in LAP time difference calculating circuit, LAP time difference signal is output into output signal memory circuit 4, and informing element 6 is driven in accordance with the LAP time difference. That is, through LAP operation, LAP time difference between LAP time and standard LAP time can be recognized by informing function.

Figure 7:
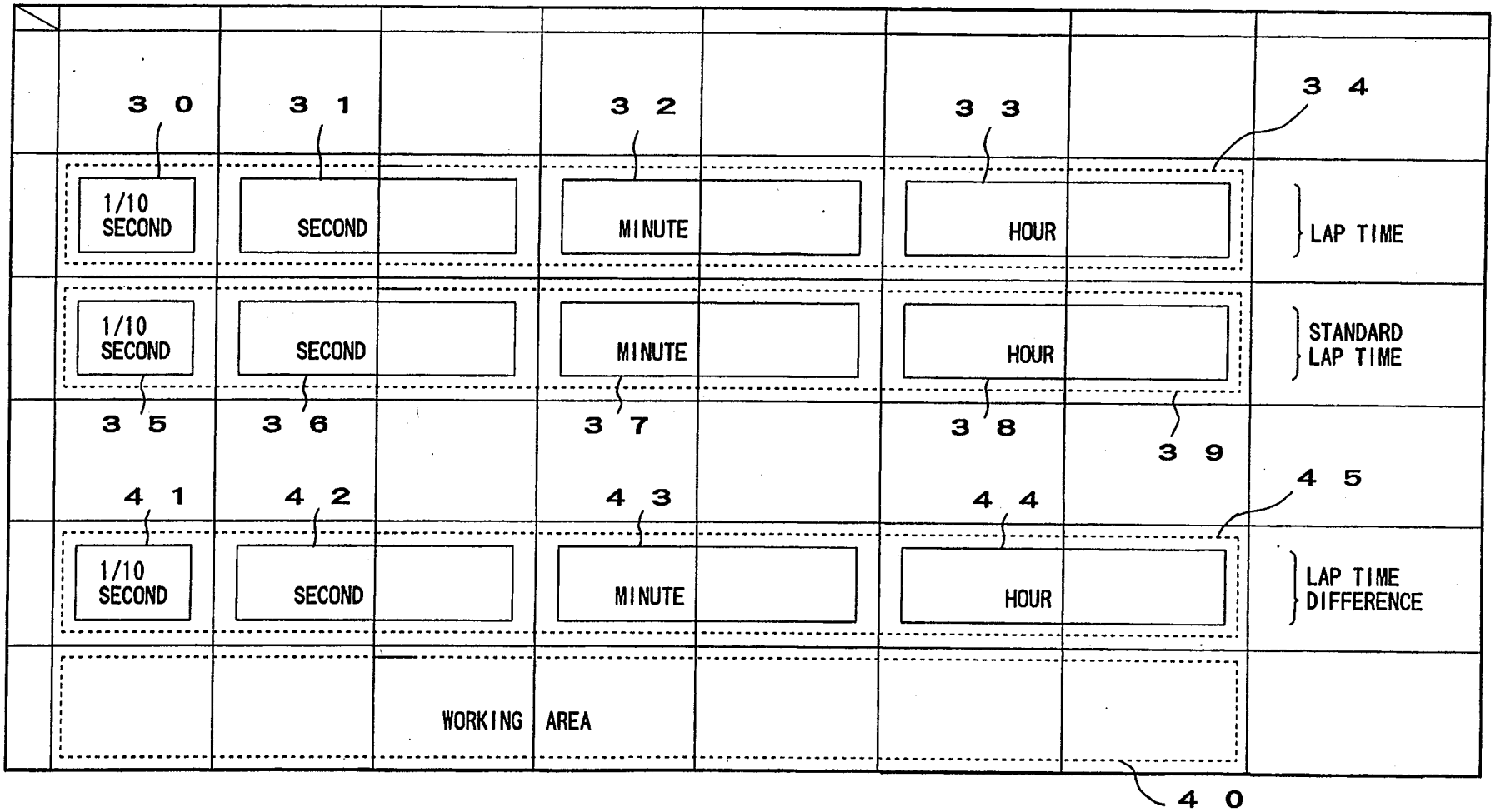
FIG. 7 shows a RAM MAP of the second embodiment in a time measurement apparatus in the present invention.

An external appearance drawing and a systems block diagram of the second embodiment is the same as of the first embodiment. FIG. 7 shows RAM MAP of the second embodiment of a time measurement apparatus in the present invention. The difference from the first embodiment is that an area 45 for memorizing LAP time difference is added. The area 45 consists of 1/10 second datum 41, second datum 42, minute datum 43, and hour datum 44. The data of LAP time difference are memorized into the area 45.

Figure 10:
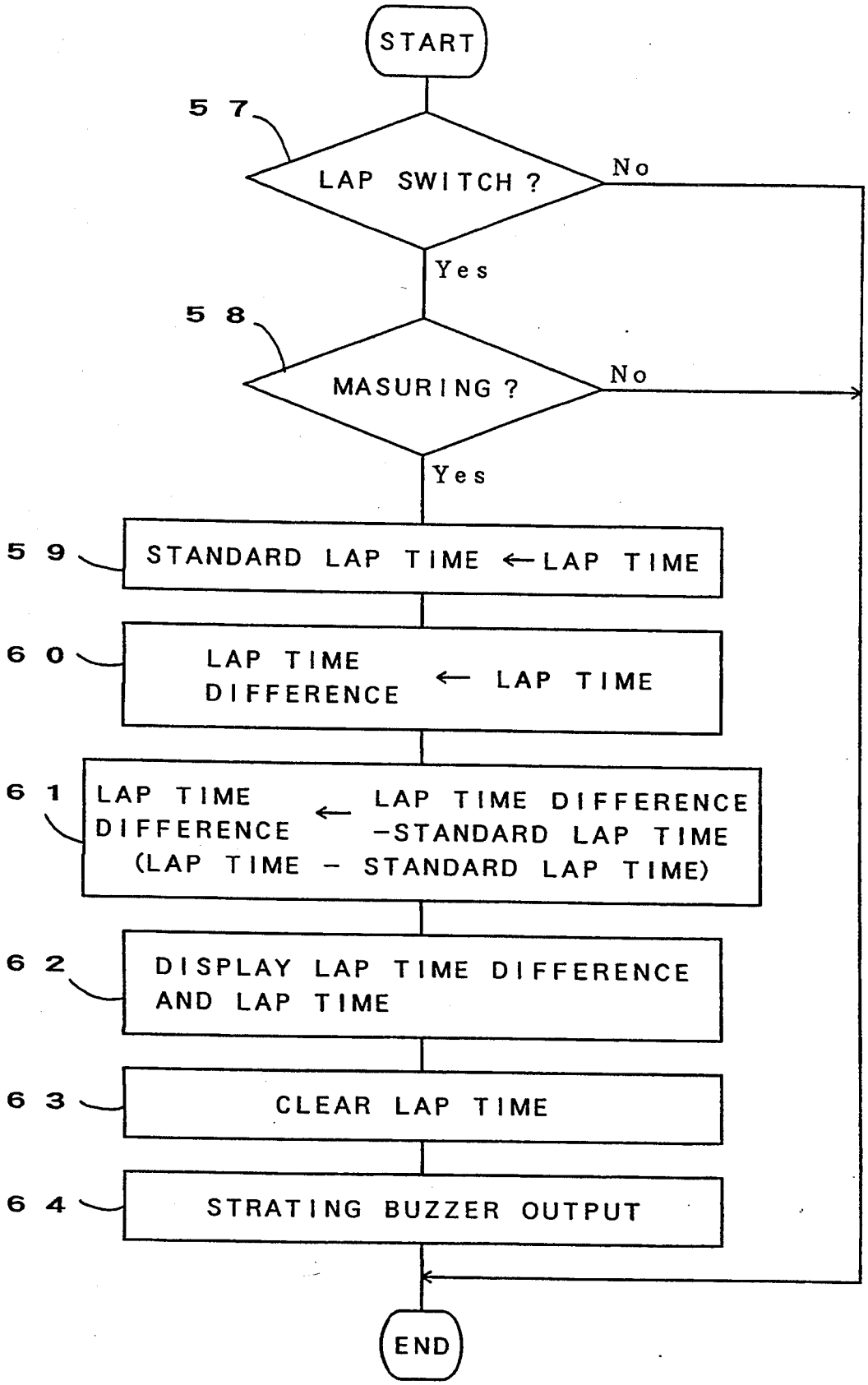
FIG. 10 shows a flow chart of LAP switch operation procedure of the second embodiment in a time measurement apparatus in the present invention.

FIG. 10 shows a flow chart of procedure of LAP time switch operation in the second embodiment of a time measurement apparatus in the present invention. Operation in the second embodiment will be explained in the flowing according to the flow chart. In case that the switch to be input is LAP switch (step 57), and in case that LAP time is now in process of measurement (step 58), the following steps will be processed. LAP time datum is transferred to a standard LAP time data area (step 59), and is substituted for the standard LAP time at the next LAP operation. For preparation of calculating LAP time difference, LAP time datum is transferred to the LAP time difference data area (step 60). Using LAP time difference data area, a standard LAP time datum is deducted from LAP time difference datum. Since LAP time difference is equal to LAP time (based on step 60), standard LAP time deducted in reality from LAP time (step 61). Then, LAP time difference and LAP time are displayed (step 62), LAP time is cleared (step 63) and output for a buzzer is initiated (step 64).

Figure 12:
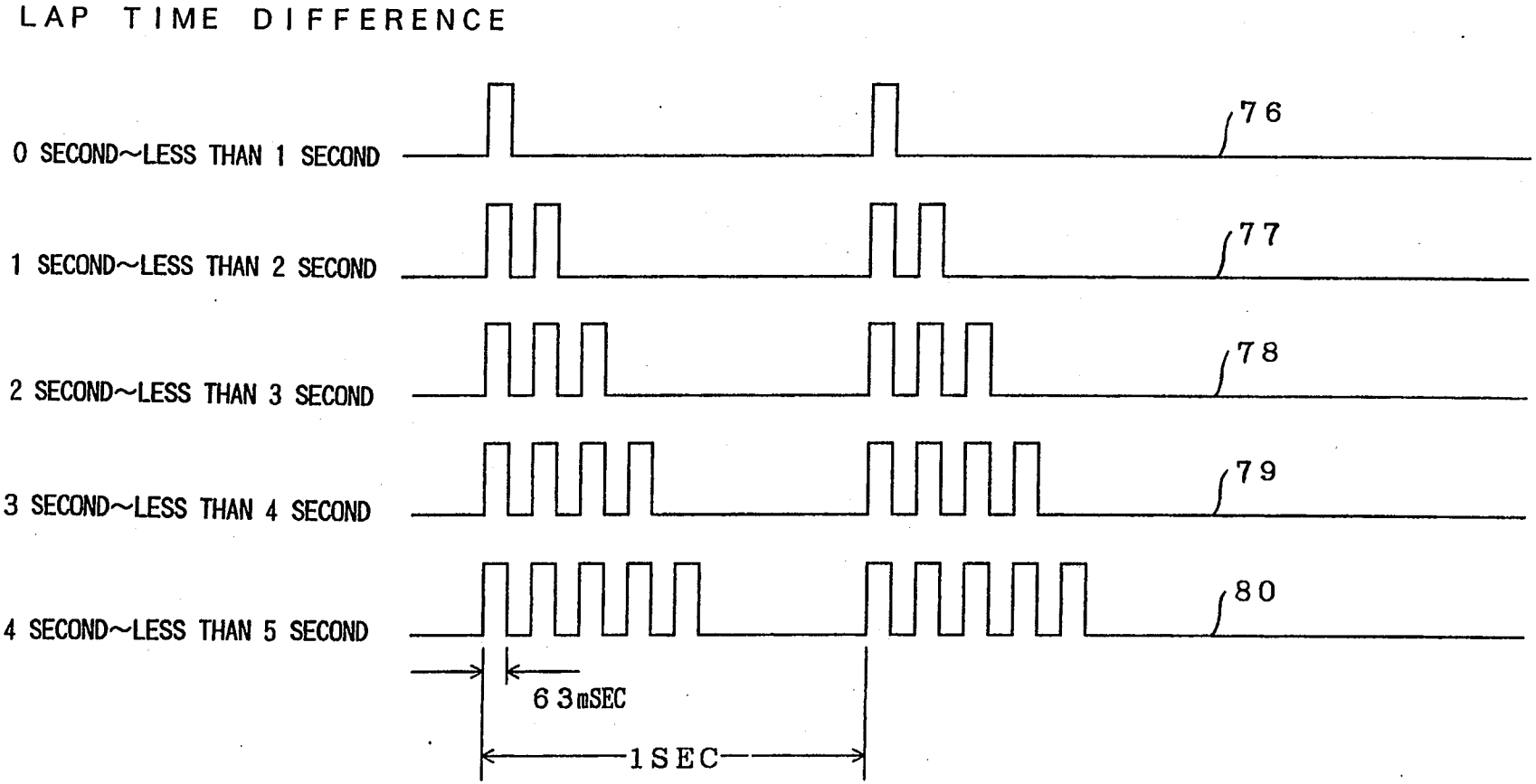
FIG. 12 shows a buzzer driving wave form of the second embodiment in a time measurement apparatus in the present invention.

FIG. 12 shows a buzzer driven wave form in the second embodiment of a time measurement apparatus in the present invention. Once LAP time difference is calculated according to LAP time difference calculation procedure, the buzzer driving wave in accordance with LAP time difference as shown in FIG. 12 is output to a buzzer 24 from a buzzer driving circuit 25. When LAP time difference is 0 second to less than 1 second, a shot sound output signal of about 63 mili-seconds is generated two times (driving wave from 76). When LAP time difference is 1 second to less than 2 second, two shot sound output signals of about 63 mili-seconds are generated two times (driving wave form 77). In the same manner as above, other shot sound output signals are generated according to various LAP time differences (driving wave forms 78–80).

By LAP operation as shown above are output as many shot sound output signals as to the LAP time difference between current LAP time and standard LAP time. At this moment, there exists the chance that LAP time comes earlier or later than a standard LAP time. This distinction can be identified using different sounds for each other case. The following differentiation may be good for such identification. In case that LAP time is earlier than standard LAP time, 2 kHz in frequency may be used, and in case that LAP time is later than standard LAP time 4 kHz in frequency may be used.

Concerning the first embodiment and the second embodiment in the present invention, the previous LAP time is used for standard LAP time in the example. But standard LAP time may not necessarily be the previous LAP time. For example, a user's predetermined target LAP time may be also used as a standard LAP time for its comparison base.

According to the present invention as is explained above, information conveyance is done when LAP time now in process of measurement comes to and/or fall into a certain length of time just before a standard LAP time, and by LAP operation, informing function in done in accordance with the LAP time difference between a LAP time just now measured and a standard LAP time. Therefore, users can avoid the necessary and troublesome frequent confirmation, by looking into the display means, in every LAP of every turn of a circuit race, since they can confirm next LAP operation timing or LAP time difference by way of informing function in the present invention, while they are watching races.

What is claimed is:

1. A time measurement apparatus for displaying time measuring information comprising:

a switch for controlling time measurement activity;

LAP time measuring means for measuring a LAP time;

standard LAP time memory means for storing a standard LAP time measured by said LAP time measuring means and/or a LAP time that is set with discretion by said switch;

LAP time watching means for automatically and continually determining the difference between a current LAP time being measured and a time period obtained by subtracting a preset time from the standard LAP time and for issuing an output signal when the difference is zero;

output signal memory means that generates an output driving signal in accordance with the output of said LAP time watching means;

driving means for providing a driving signal in accordance with the output signal from said output signal memory means; and informing means for indicating the coincidence of LAP time in accordance with the driving signal from said driving means.

2. A time measurement apparatus for displaying time measuring information comprising:

a switch for controlling time measurement activity;

LAP time measuring means for measuring a LAP time;

standard LAP time memory means for storing a standard LAP time measured by said LAP time measuring means and/or a LAP time that is set with discretion by said switch;

LAP time difference calculating means for automatically and continually determining the difference between a current LAP time being measured add the standard LAP time and for issuing an output signal when the difference is zero;

output signal memory means that generates an output driving signal in accordance with the output of the LAP time difference calculating means;

driving means for providing a driving signal in accordance with the output signal from said output signal memory means; and informing means for indicating LAP time difference information in accordance with the driving signal from said driving means.

3. A time measurement apparatus according to claim 1 or claim 2, wherein said LAP time measuring means measures hour, minute, second, and 1/10 second.

4. A time measurement apparatus according to claim 1 or claim 2, further comprising:

display control means for controlling the display signal of LAP time and/or standard LAP time; and display means for displaying LAP time and/or standard LAP time.

5. A time measurement apparatus according to claim 4, wherein said display means has an analog display element.

6. A time measurement apparatus according to claim 4, wherein said display means displays split time.

7. A time measurement apparatus according to claim 1 or claim 2, wherein said informing means produces an audible output sound.

8. A time measurement apparatus according to claim 1 or claim 2, wherein said informing means produces a plurality of different audible output sounds.

9. A time measurement apparatus according to claim 1 or claim 2, wherein said informing means has a motor for generating vibration.

10. A time measurement apparatus comprising:

LAP time measuring means for measuring a current LAP time;

standard LAP time memory means for memorizing a standard LAP time which is measured and/or set;

LAP time watching means for automatically and continually comparing the current LAP time and the standard LAP time, and for outputting a LAP time concurrent information signal when the current LAP time equals the standard LAP time; and informing means which receives said LAP time concurrent information signal, and produces a signal in accordance with the coincidence of LAP times.

11. A time measurement apparatus according to claim 10, wherein said LAP time measuring means measures hour, minute, second, and 1/10 second.

12. A time measurement apparatus according to claim 10, further comprising:

display control means for controlling the display signal of the current LAP time and/or standard LAP time; and display means for displaying the current LAP time and/or standard LAP time.

13. A time measurement apparatus according to claim 10 further comprising:

display means for displaying time information and split time.

14. A time measurement apparatus according to claim 10, wherein said informing means produces an audible output sound.

15. A time measuring means for measuring a current LAP time, comprising:

standard LAP time memory means for memorizing a standard LAP time which is measured and/or set by a user;

means for automatically and continually determining the difference between the current lap time being measured and a time period obtained by subtracting a preset time from the standard LAP time and for issuing an a signal when the difference is zero; and means receptive of the signal for producing an output signal indicating that the current lap time is approaching the standard lap time.

16. A time measurement apparatus according to claim 15, further comprising display control means for controlling the display of the current LAP time and/or standard LAP time; and display means for displaying the current LAP time and/or standard LAP time.

17. A time measurement apparatus according to claim 15, wherein said means for producing an output signal includes means for producing an audible output sound.

* * * * *